US005603989A

United States Patent [19]

Tomaru et al.

[11] Patent Number: 5,603,989

[45] Date of Patent: Feb. 18, 1997

[54] EXTRUSION COATING METHOD INCLUDING ADJUSTING THE DISTANCE BETWEEN COATING HEAD SLOT AND THE POINTS OF TANGENCY WHERE A FLEXIBLE SUPPORT CONTACTS RESPECTIVE SUPPORT ROLLS

[75] Inventors: Mikio Tomaru; Norio Shibata; Shinsuke Takahashi, all of Kanagawa, Japan

[73] Assignee: Fuji Photo Film Co., Ltd., Kanagawa, Japan

[21] Appl. No.: 575,521

[22] Filed: Dec. 20, 1995

[30] Foreign Application Priority Data

Dec. 26, 1994 [JP] Japan ..... 6-336740

[51] Int. Cl.[6] ..... B05D 1/26

[52] U.S. Cl. ..... 427/356; 427/358; 427/128; 118/410

[58] Field of Search ..... 427/356, 128, 427/358; 118/410

[56] References Cited

U.S. PATENT DOCUMENTS

| | | | |
|---|---|---|---|
| 4,388,349 | 6/1983 | Korpman et al. | 427/208.4 |
| 4,681,062 | 7/1987 | Shibata et al. | 118/410 |
| 4,717,603 | 1/1988 | Chino et al. | 427/434.3 |
| 5,202,164 | 4/1993 | Takahashi et al. | 427/356 |
| 5,397,600 | 3/1995 | Shibata et al. | 427/356 |
| 5,418,004 | 5/1995 | Chin et al. | 427/356 |

*Primary Examiner*—Katherine A. Bareford

*Attorney, Agent, or Firm*—Sughrue, Mion, Zinn, Macpeak & Seas

[57] ABSTRACT

A coating method in which a surface of a web 7, which is supported by a pair of support rolls 2 and 3 so as to run continuously along a back edge surface 4 and a doctor edge surface 5 of a coating head 1, is coated with a coating composition by the coating head 1. The coating method includes setting an optimum coating condition by adjusting the distance b from a top end portion 10 of a slot 6 to each of the points of tangency 8 and 9 where the web 7 contacts the respective support rolls 2 and 3 on the basis of a relation expression under the consideration of the thickness t, Young's modulus E and Poisson's ratio ν of the web 7, the deviation δ of rotation due to the eccentricity of each of the support rolls 2 and 3, and the carrying tension T per unit width of the web 7; and extruding the coating composition continuously from the top end portion 10 of the slot 6 of the coating head 1 to the surface of the web 7. Accordingly, a good coating method is provided in which a uniform coating layer can be obtained on the basis of the clarification of a coating condition in which a coating composition is applied onto a thin web without the occurrence of any stripe irregularity and/or any thickness irregularity.

6 Claims, 3 Drawing Sheets

EXTRUSION COATING METHOD INCLUDING ADJUSTING THE DISTANCE BETWEEN COATING HEAD SLOT AND THE POINTS OF TANGENCY WHERE A FLEXIBLE SUPPORT CONTACTS RESPECTIVE SUPPORT ROLLS

BACKGROUND OF THE INVENTION

1. Field of the Invention

The present invention relates to a coating method and, more particularly, to a coating method in which a surface of a flexible support (hereinafter referred to as a "web") made of plastic film, paper, metal foil, or the like, is continuously and uniformly coated with a coating composition at a high speed by means of an extrusion coating apparatus.

2. Description of the Related Art

As the coating method for applying a coating composition such as a magnetic coating composition, a photographic light-sensitive coating composition, or the like, onto a surface of a web, conventionally, coating methods using an extrusion coating apparatus, a curtain flow coating apparatus, a blade doctor coating apparatus, a slide coat coating apparatus, etc. are generally known. Of these methods, a coating method using an extrusion coating apparatus is employed in various fields because uniform thin layer coating can be accomplished (see, for example, U.S. Pat. No. 4,681,062, Japanese Patent Postexamination Publication Nos. Hei-1-46186 and Sho-63-88080, Unexamined Japanese Patent Publication Nos. Hei-2-174965 and Hei-2-265672, etc.)

The extrusion coating apparatus is a coating apparatus in which a coating composition is continuously discharged from a slot 24 between a back edge and a doctor edge so as to be applied onto a surface of a web 7 which is stretched by support rolls 2 and 3 located upstream and downstream, respectively, of a coating head 21 and which runs continuously along a back edge surface 22 and a doctor edge surface 23, as shown in FIGS. 5 and 6. The extrusion coating apparatus has at least one slot.

In recent years, the high-density and multilayer structure of a magnetic recording layer has been developed in the field of magnetic recording media, or the like. With the advance of the magnetic recording media, reduction of coating thickness of the magnetic layer applied onto a web has been required in a process of producing such magnetic recording media. On the other hand, in order to improve the productivity, it is required to increase the coating speed for applying a coating composition onto a web. Furthermore, with the advance of improvements of such a web, a thin web made of polyethylene naphthalate, aramid, or the like, and having a thickness of not larger than 10 μm has been used.

When a coating composition is applied onto such a thin web having a thickness of not larger than 10 μm by means of a coating method using such an extrusion coating apparatus as described above, however, there is a problem in that stripe irregularity of about 0.5 μm with the pitch of from the order of several mm to the order of ten and several mm occurs in the coating layer over the direction of the width of the web, or thickness irregularity occurs in the direction of the width of the coating layer periodically over the direction of the length of the web.

Particularly, such stripe irregularity and thickness irregularity occur easily in the case where the thickness of the web is not larger than 10 μm, so that these irregularities have a detrimental influence on the electromagnetic conversion characteristics such as output, C/N ratio, etc. Accordingly, the coating condition is conventionally determined by trial and error, but the yield is poor so that production efficiency is bad and quality is unstable.

Therefore, the inventors of the present invention have diligently examined the cause of the occurrence of the aforementioned stripe irregularity. As a result, it has been discovered that because the web 7 is pressed against the coating head 1 by the support rolls 2 and 3 located at the upstream and downstream sides, respectively, of the coating head 21 at the time of coating, the thin web 7 is buckled in the direction of the width of the web between the coating head 21 and each of the support rolls 2 and 3 as shown in FIG. 5 so that the contacting force between the coating head 21 and the web 7 is not uniform to thereby bring about the occurrence of stripe irregularity. For this reason, such buckling of the web 7 occurs easily when the thickness of the web is very thin so as to be not thicker than 10 μm.

It has been further discovered that, if the distance between the coating head 21 and each of the support rolls 2 and 3 is reduced in order to prevent the buckling of the web 7, the running web 7 is moved up and down by the deviation δ (only the deviation δ of the support roll 3 is shown in the drawing) of rotation caused by the eccentricity of each of the support rolls 2 and 3 as shown in FIG. 6 so that the web contact force on the coating head 21 is changed by the up and down movement of the web 7, and therefore the coating thickness of the coating layer changes so that the thickness irregularity occurs periodically over the direction of the length of the web 7.

SUMMARY OF THE INVENTION

Therefore, an object of the present invention is to solve the aforementioned problems and to provide a good coating method in which a uniform coating layer can be obtained on the basis of the clarification of a coating condition in which a coating composition is applied onto a thin web without the occurrence of any stripe irregularity and/or thickness irregularity.

The foregoing object of the present invention is achieved by a coating method including continuously running a surface of a flexible support, supported by a pair of support rolls, along a back edge surface and a doctor edge surface; and coating the surface of the support with a coating composition in a region between the pair of support rolls by an extrusion coating apparatus which extrudes the coating composition continuously from a top end portion of a slot onto the surface of the support, the improvement comprising:

performing the coating under a condition wherein a distance b (mm) from the top end portion of said slot to each of the points of tangency on which said support contacts said respective support rolls is adjusted so as to satisfy the expression:

$$b < 1.3 \times 10^3 \times \left( \frac{\pi^2 EtT}{12(1-\nu^2)} \right)^{\frac{1}{2}}$$

where t (mm) is the thickness of the support, E (kgf/mm$^2$) is the Young's modulus of the support, ν is the Poisson's ratio of the support, and T (kgf/mm) is the carrying tension per unit width of the support.

Further, the foregoing object of the present invention is achieved by a coating method including continuously running a surface of a flexible support, supported by a pair of support rolls, along a back edge surface and a doctor edge surface; and coating the surface of the support with a coating composition in a region between the pair of support rolls by an extrusion coating apparatus which extrudes the coating composition continuously from a top end portion of a slot onto the surface of the support, the improvement comprising:

performing the coating under a condition wherein a distance b (mm) from the top end portion of said slot to each of the points of tangency on which said support contacts said respective support rolls is adjusted so as to satisfy the expression:

$$b > t \times \left( \frac{\delta E}{7.6 \times 10^{-10} (1 - \nu^2)} \right)^{\frac{1}{3}}$$

where t (mm) is the thickness of the support, E (kgf/mm$^2$) is the Young's modulus of the support, ν is the Poisson's ratio of the support, and δ (mm) is the deviation due to the rotation of each of the support rolls.

Further, the foregoing object of the present invention is achieved by a coating method including continuously running a surface of a flexible support, supported by a pair of support rolls, along a back edge surface and a doctor edge surface; and coating the surface of the support with a coating composition in a region between the pair of support rolls by an extrusion coating apparatus which extrudes the coating composition continuously from a top end portion of a slot onto the surface of the support, the improvement comprising:

performing the coating under a condition wherein a distance b (mm) from the top end portion of said slot to each of the points of tangency on which said support contacts said respective support rolls is adjusted so as to satisfy the expression:

$$t \times \left( \frac{\delta E}{7.6 \times 10^{-10} (1 - \nu^2)} \right)^{\frac{1}{3}} < b < 1.3 \times 10^3 \times \left( \frac{\pi^2 E t T}{12(1 - \nu^2)} \right)^{\frac{1}{2}}$$

where t (mm) is the thickness of the support, E (kgf/mm$^2$) is the Young's modulus of the support, ν is the Poisson's ratio of the support, T (kgf/mm) is the carrying tension per unit width of the support, and δ (mm) is the deviation due to the rotation of each of the support rolls.

Incidentally, the coating composition in the present invention is a coating composition which exhibits a thixotropic viscosity characteristic wherein the viscosity decreases as the shear rate increases, such as a magnetic coating composition, a photographic light-sensitive coating composition, or the like. Further, the flexible support in the present invention is a very thin flexible support having a thickness of 3 μm to 10 μm. Particularly, the present invention is effective for the support having a thickness of 4 μm to 10 μm.

BRIEF DESCRIPTION OF THE DRAWINGS

The above objects and advantages of the present invention will become more apparent by describing in detail preferred embodiments thereof with reference to the attached drawings, in which.

DETAILED DESCRIPTION OF THE PREFERRED EMBODIMENTS

An embodiment of the present invention will now be described below in detail with reference to the accompanying drawings.

Figure 1:
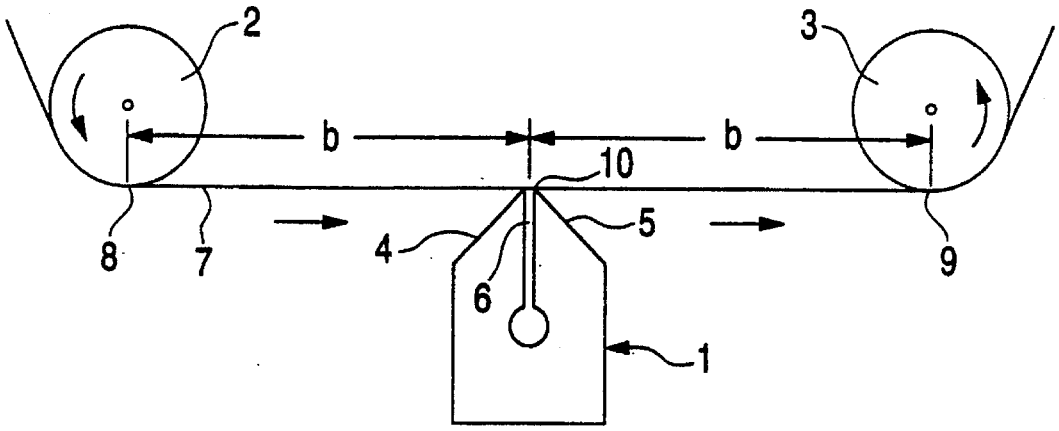
FIG. 1 is a schematic diagram of an extrusion coating apparatus for carrying out a coating method according to the present invention.

FIG. 1 shows the outline of an extrusion coating apparatus for carrying out a coating method according to the present invention. A coating composition is continuously discharged from a slot 6 between a back edge and a doctor edge so as to be applied onto a surface of a web 7 which is stretched by support rolls 2 and 3 located at the upstream and downstream sides, respectively, of a coating head 1 and which runs continuously along a back edge surface 4 and a doctor edge surface 5.

Further, the distance b (mm) from a top end portion 10 of the slot 6 in the coating head 1 to points of tangency 8 and 9 where the web 7 contacts the respective upstream and downstream support rolls 2 and 3 is adjusted to satisfy the following expression (1).

$$b < 1.3 \times 10^3 \times \left( \frac{\pi^2 E t T}{12(1 - \nu^2)} \right)^{\frac{1}{2}} \quad \text{Expression (1)}$$

In the aforementioned expression, t is the thickness (mm) of the web 7, E is the Young's modulus (kgf/mm$^2$) of the web 7, ν is the Poisson's ratio of the web 7, and T is the carrying tension (kgf/mm) per unit width of the web 7.

Figure 2:
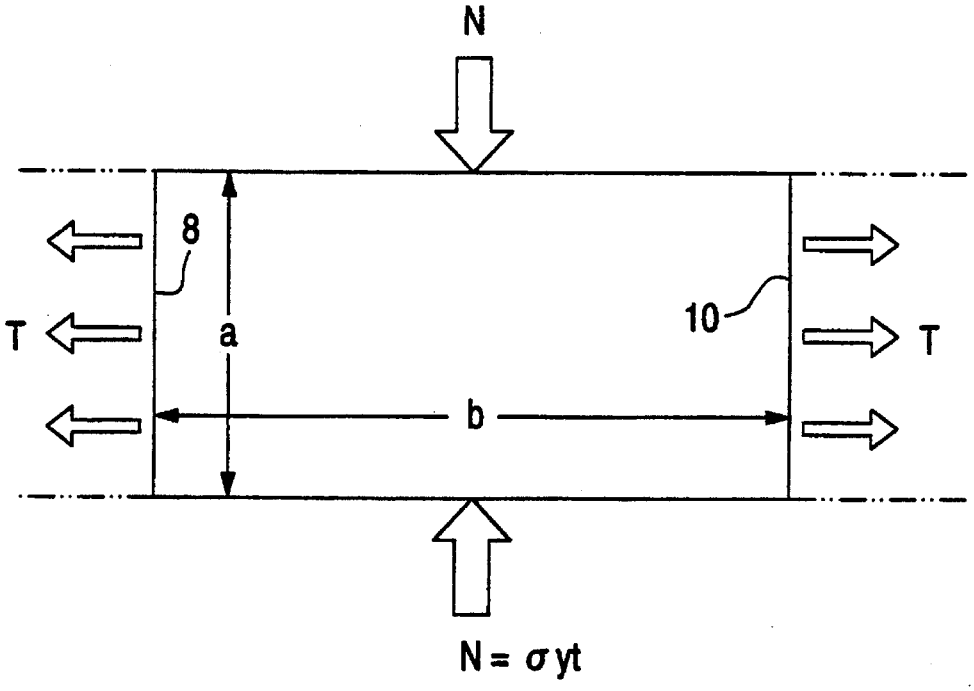
FIG. 2 is a typical diagram showing a model for explaining the buckling of a web between an upstream support roll depicted in FIG. 1 and a coating head.

The aforementioned expression is obtained by theoretically examining the buckling of the web 7 between each of the upstream and downstream support rolls 2 and 3 and the coating head 1 in the model case where tension T per unit width acts lengthwise on a rectangular thin plate having a width a, a length b and a thickness t. As shown in FIG. 2, it is assumed that the width of the web, the distance from the slot top end portion 10 to the point of tangency 8 where the web 7 contacts the support roll 2 and the thickness of the web 7 are a, b and t, respectively, and that a widthwise compressing force N acts on the thin plate.

Further, when the lengthwise coordinate of the web, the widthwise coordinate of the web and flexure in a direction perpendicular to the x–y plane are y, x and w, respectively, the following expression (1A) holds.

$$D \left( \frac{\partial^4 w}{\partial x^4} + 2 \frac{\partial^4 w}{\partial x^2 \partial y^2} + \frac{\partial^4 w}{\partial y^4} \right) = -N \frac{\partial^2 w}{\partial x^2} + T \frac{\partial^2 w}{\partial y^2} \quad \text{Expression (1A)}$$

In the expression, D expresses the bending stiffness of the web and is given by the following expression (1B).

$$D=\frac{Et^3}{12(1-\nu^2)} \quad \text{Expression (1B)}$$

As a boundary condition, the flexure and moment in four sides are set at zero. Accordingly, when buckling occurs, flexure w can be estimated as indicated by the following expression (1C).

$$w=Cmn\sin\frac{m\pi}{a}x\cdot\sin\frac{n\pi}{b}y \quad \text{Expression (1C)}$$

(Cmn: constant, m: the number of x-direction half-waves, y: the number of y-direction half-waves) When critical buckling stress $\sigma x_{cr}$ (the minimum value of N/t) is obtained by substituting the expression (1C) for the expression (1A), the following expression (1D) is given. Further, buckling wavelength λ is obtained as indicated by the following expression (1E).

$$\sigma x_{cr}=\frac{N}{t}=\frac{2}{b}\sqrt{\frac{\pi^2EtT}{12(1-\nu^2)}} \quad \text{Expression (1D)}$$

$$\lambda=2\times b^{\frac{1}{2}}\times\left(\frac{\pi^2Et^3}{12(1-\nu^2)T}\right)^{\frac{1}{4}} \quad \text{Expression (1E)}$$

Figure 3:
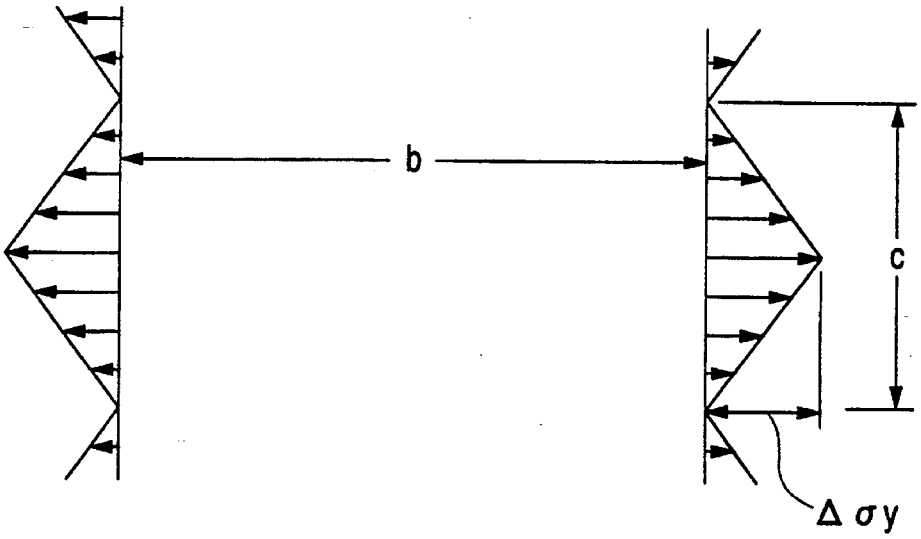
FIG. 3 is an explanatory diagram showing a stress distribution in the model of a web depicted in FIG. 2.

It is apparent from the analytic result that when compressing stress larger than $\sigma x_{cr}$ acts in the widthwise direction, buckling occurs and the buckling wavelength becomes λ. The following fact is considered as a cause of generation of the compressing stress. The web generally has a thickness distribution and a Young's modulus distribution. Therefore, when tension for carrying the web is applied, a widthwise internal stress distribution is generated. Assuming now that a convex stress distribution as shown in FIG. 3 is generated in a part of the web, then widthwise compressing stress σx as indicated by the following expression (1F) is generated in the center portion of the web. This stress brings about buckling.

$$\sigma_x=\frac{1}{5}\left(\frac{c}{b}\right)^2\Delta\sigma_y \quad \text{Expression (1F)}$$

Here, the size of the widthwise compressing stress σx can be obtained experimentally. The aforementioned critical buckling stress $\sigma x_{cr}$ can be changed by changing the thickness t of the web, the distance b from the slot top end portion to the point of tangency where the web contacts each of the support rolls, the carrying tension T per unit width of the web and the Young's modulus E of the web to make it possible to check whether buckling occurs or not.

After components of the following composition were put into a ball mill and mixed and dispersed sufficiently, 30 parts by weight of epoxy resin (epoxy equivalent: 500) was added thereto and mixed and dispersed uniformly to thereby prepare a magnetic coating composition (magnetic dispersion). Further, methyl ethyl ketone used as a precoat solution to be applied onto the support in advance was applied by a bar coater coating method to form a wet thickness of 4.0 g/m$^2$.

(Magnetic Coating Composition)

γ-$Fe_2O_3$ powder 300 parts by weight (needle-like particles having a mean particle size of 0.5 μm in the major axis, and a magnetic coercing force of 320 Oe)

vinyl chloride-vinyl acetate copolymer 30 parts by weight (copolymerization ratio 87:13, polymerization degree 400)

methyl ethyl ketone 300 parts by weight n-butanol 100 parts by weight

For reference, the balanced viscosity of the magnetic coating composition thus prepared was measured by Shimadzu Reometer RM-1 made by Shimadzu Seisakusho Corporation. As a result, the balanced viscosity was 60 poise when the shear rate was 10 sec$^{-1}$.

On the other hand, the aforementioned magnetic coating composition was applied onto a web in the following coating condition by using a coating head having the same structure as that disclosed in Japanese Patent Postexamination Publication No. Hei-5-8065 as a coating apparatus.

(Coating Condition)

web material . . . polyethylene terephthalate film

Poisson's ratio . . . 0.2 width . . . 1000 (mm)

coating speed . . . 300 (m/min)

wet coating thickness . . . 30 (μm)

Further, not only critical buckling stress $\sigma x_{cr}$ in respective coating conditions was calculated on the basis of the expression (1D) by appropriately changing the thickness t of the web, the distance b from the slot top end portion to the point of tangency where the web contacts each of the support rolls, the carrying tension T per unit width of the web and the Young's modulus E of the web, but also the surface of the coating layer was observed to check whether stripe irregularity occurred or not. Results thereof are shown in Table 1. In addition, the pitch of the stripe irregularity was examined when stripe irregularity occurred.

TABLE 1

| E (kgf/mm$^2$) | ν | t (mm) | T (kgf/mm) | b (mm) | $\sigma x_{cr}$ (kgf/mm$^2$) | state of irregularity occurence (irregularity pitch mm) | theortical buckling wave-length (mm) |
|---|---|---|---|---|---|---|---|
| 400 | 0.2 | $6\times10^{-3}$ | $15\times10^{-3}$ | 230 | $1.5\times10^{-3}$ | none | |
| 400 | 0.2 | $6\times10^{-3}$ | $15\times10^{-3}$ | 250 | $1.4\times10^{-3}$ | 8–9 | 8.4 |
| 400 | 0.2 | $4\times10^{-3}$ | $15\times10^{-3}$ | 190 | $1.5\times10^{-3}$ | none | |
| 400 | 0.2 | $4\times10^{-3}$ | $15\times10^{-3}$ | 200 | $1.4\times10^{-3}$ | 5–6 | 5.5 |
| 400 | 0.2 | $4\times10^{-3}$ | $10\times10^{-3}$ | 155 | $1.5\times10^{-3}$ | none | |
| 400 | 0.2 | $4\times10^{-3}$ | $10\times10^{-3}$ | 160 | $1.4\times10^{-3}$ | 5–6 | 5.5 |
| 600 | 0.2 | $4\times10^{-3}$ | $15\times10^{-3}$ | 230 | $1.5\times10^{-3}$ | none | |
| 600 | 0.2 | $4\times10^{-3}$ | $15\times10^{-3}$ | 245 | $1.4\times10^{-3}$ | 6–7 | 6.8 |
| 600 | 0.2 | $15\times10^{-3}$ | $15\times10^{-3}$ | 450 | $1.5\times10^{-3}$ | none | |
| 600 | 0.2 | $15\times10^{-3}$ | $15\times10^{-3}$ | 480 | $1.4\times10^{-3}$ | 25–26 | 25.6 |

It is apparent from Table 1 that the pitch of stripe irregularity occurring in the aforementioned experimental example has a very good correspondence to buckling wavelength λ obtained by the analytic expression (1E). From the fact that stripe irregularity occurred when the critical buckling stress $\sigma x_{cr}$ is smaller than $1.5\times10^{-3}$ (kgf/mm$^2$), it is further apparent that widthwise compressing stress of $1.5\times10^{-3}$ (kgf/mm$^2$) always acts on the web. Accordingly, when the distance b from the slot top end portion to the point of tangency where the web contacts the support roll is adjusted at least to make the critical buckling stress $\sigma x_{cr}$ always larger than $1.5\times10^{-3}$ (kgf/mm$^2$), the coating composition can be applied onto a thin web having a thickness of not larger than 10 μm without any stripe irregularity so that a uniform coating layer can be obtained. That is, the distance b need be adjusted to satisfy the aforementioned expression (1).

Then, a coating condition for preventing the thickness irregularity caused by the eccentricity of each of the support rolls was examined. As a result, it was found that the distance b (mm) from the slot top end portion 10 of the coating head 1 to each of the points of tangency 8 and 9 where the web 7 contacts the respective upstream and downstream support rolls 2 and 3 need be adjusted to satisfy the following expression (2).

$$b > t\times\left(\frac{\delta E}{7.6\times10^{-10}(1-\nu^2)}\right)^{\frac{1}{3}} \qquad \text{Expression (2)}$$

In the aforementioned expression (2), t is the thickness (mm) of the web 7, E is the Young's modulus (kgf/mm$^2$) of the web 7, ν is the Poisson's ratio of the web 7, and δ (mm) is the deviation (mm) of rotation caused by the eccentricity of each of the support rolls 2 and 3.

Figure 4:
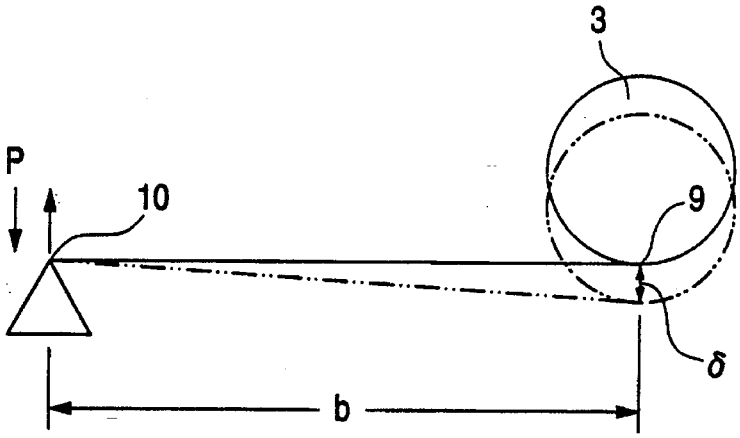
FIG. 4 is a typical diagram showing a model for explaining the relation between the deviation of rotation caused by the eccentricity of a downstream support roll depicted in FIG. 1 and the web contact pressure on the coating head.
Figure 5:
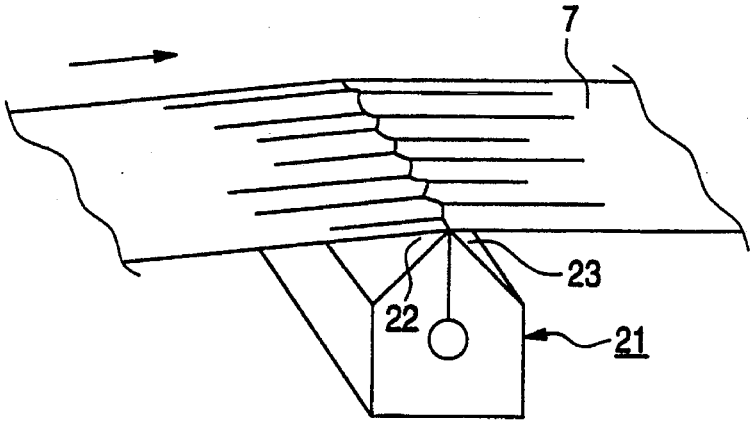
FIG. 5 PRIOR ART
FIG. 5 is a schematic perspective diagram showing a conventional coating state obtained by an extrusion coating apparatus.
Figure 6:
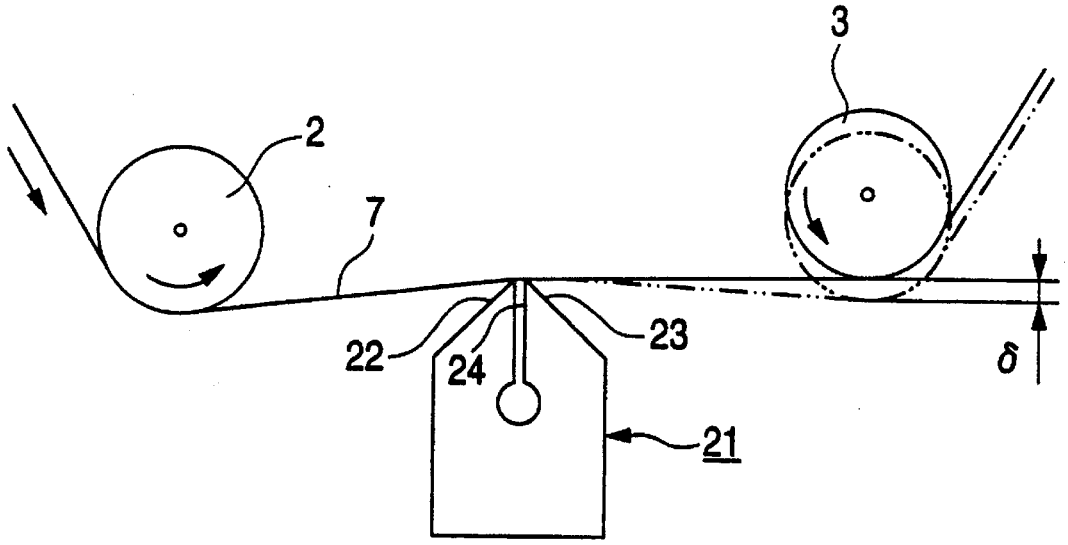
FIG. 6 PRIOR ART
FIG. 6 is a schematic diagram for explaining the deviation of rotation caused by the eccentricity of the downstream support roll in the conventional coating method depicted in FIG. 5.

The aforementioned expression (2) is obtained by theoretically examining web contact pressure P at the slot top end portion 10 of the coating head 1 when deviation δ acts on a free end of a cantilever having a length b and a thickness t as shown in FIG. 4 as a model.

Here, the web contact pressure P is calculated as indicated by the following expression (2A).

$$P=\frac{\delta E t^3}{4b^3(1-\nu^2)} \qquad \text{Expression (2A)}$$

Therefore, the web contact pressure P was changed by changing the thickness t of the web 7, the distance b from the slot top end portion 10 to the point of tangency where the web 7 contacts the support roll 3 and the deviation δ of rotation caused by the eccentricity of the support roll 3, and the magnetic coating composition was applied practically, so that the situation of occurrence of the thickness irregularity was rearranged with respect to the web contact pressure P. As a result, the results as shown in the following Table 2 were discovered. Incidentally, the coating condition was selected to be the same as the aforementioned coating condition.

It is apparent from Table 2 that the thickness irregularity does not occur if the web contact pressure P is smaller than $1.9\times10^{-10}$ (kgf/mm). Accordingly, when the distance b from the slot top end portion to the point of tangency where the web contacts the support roll is adjusted at least to make the web contact pressure P always smaller than $1.9\times10^{-10}$ (kgf/mm), the coating composition can be applied onto a thin web having a thickness of 4 μm to 10 μm so that a uniform coating layer can be obtained. That is, because the minimum value of the distance b in which there is no influence of the deviation δ of rotation caused by the eccentricity of the support roll is obtained on the basis of $1.9\times10^{-10}$ (kgf/mm) which is a critical value of the web contact pressure P, the distance b need be adjusted to satisfy the aforementioned expression (2).

More preferably, when the distance b is adjusted to satisfy the following expression (3) deduced from the aforementioned expressions (1) and (2), the coating composition can be applied onto a thin web having a thickness of not larger than 10 μm without any stripe irregularity and any thickness irregularity so that a uniform coating layer can be obtained.

$$t\times\left(\frac{\delta E}{7.6\times10^{-10}(1-\nu^2)}\right)^{\frac{1}{3}} < b < 1.3\times 10^3\times\left(\frac{\pi^2 E t T}{12(1-\nu^2)}\right)^{\frac{1}{2}} \qquad \text{Expression (3)}$$

Accordingly, magnetic recording media having a good magnetic layer without any stripe irregularity and any thickness irregularity exerting a bad influence on the electromagnetic conversion characteristics such as output, C/N ratio, or the like, even on a thin web having a thickness of not larger than 10 μm can be produced efficiently.

Although a coating apparatus in which a coating composition is continuously discharged from a slot between a back edge and a doctor edge so as to be applied onto a surface of a web which is stretched by support rolls located at the upstream and downstream sides, respectively, of a coating head and which runs edge surface is used in the aforementioned embodiment, it is a matter of course that the present invention is not limited thereto but can be applied to various coating apparatuses.

For example, there is the case where a coating head for precoating and a coating head for the coating composition are arranged between the pair of support rolls. In this case, the distance between the upstream support roll and the precoat coating head and the distance between the coating composition coating head and the downstream support roll are respectively set so as to satisfy the condition of the distance b in the present invention. Further, in the case where

TABLE 2

| E (kgf/mm$^2$) | ν | t (mm) | δ (mm) | b (mm) | P (kgf/mm) | state of irregularity occurence |
|---|---|---|---|---|---|---|
| 600 | 0.2 | $6\times10^{-3}$ | 0.05 | 20 | $2.1\times10^{-10}$ | exist |
| 600 | 0.2 | $6\times10^{-3}$ | 0.05 | 22 | $1.6\times10^{-10}$ | none |
| 600 | 0.2 | $6\times10^{-3}$ | 0.1 | 26 | $1.9\times10^{-10}$ | exist |
| 600 | 0.2 | $6\times10^{-3}$ | 0.1 | 28 | $1.5\times10^{-10}$ | none |
| 600 | 0.2 | $15\times10^{-3}$ | 0.1 | 64 | $2.0\times10^{-10}$ | exist |
| 600 | 0.2 | $15\times10^{-3}$ | 0.1 | 66 | $1.8\times10^{-10}$ | none |

the precoat is to be applied by a coating roll or by gravure coating, or the like, the condition of the distance b in the present invention is applied to the distance between the precoat coating roll and the coating head while the deviation δ in the present invention is regarded as the deviation of the coating roll. Further, in the case where the precoat is to be applied by an extrusion head, the nearer the distance between the precoat extrusion head and the coating composition coating head become, the better the result becomes.

As described above, the coating method according to the present invention is a coating method in which a surface of a flexible support supported by a pair of support rolls so as to run continuously along a back edge surface and a doctor edge surface is coated with a coating composition in a region between the pair of support rolls by an extrusion coating apparatus which extrudes the coating composition continuously from a top end portion of a slot onto the surface of the support, wherein the coating condition can be set by adjusting the distance b from the top end portion of the slot to each of the points of tangency where the support contacts the respective support rolls on the basis of a relation expression under the consideration of the thickness t of the support, the Young's modulus E of the support, the Poisson's ratio ν of the support, the deviation δ of rotation due to the eccentricity of each of the support rolls and the carrying tension T per unit width of the support, and so on. Accordingly, the condition can be adjusted to an optimum coating condition speedily, so that the production efficiency can be improved.

Accordingly, a coating condition wherein a coating composition can be applied onto a thin web without the occurrence of any stripe irregularity and any thickness irregularity is made clear, so that a good coating method in which a uniform coating layer can be obtained is provided.

It is contemplated that numerous modifications may be made to the coating method of the present invention without departing from the spirit and scope of the invention as defined in the following claims.

What is claimed is:

1. A coating method including continuously running a surface of a flexible support, supported by a pair of rotational support rolls, along a back edge surface and a doctor edge surface; and coating the surface of said support with a coating composition in a region between said pair of support rolls by an extrusion coating apparatus which extrudes said coating composition continuously from a top end portion of a slot onto the surface of said support, said pair of support rolls including an upstream roll and a downstream roll, said upstream roll defining a point of tangency which is where said support last contacts said upstream roll before extending toward said slot, and said downstream roll defining a point of tangency which is where said support first contacts said downstream roll, the improvement comprising:

performing said coating under a condition wherein a distance b (mm) from the top end portion of said slot to each of the points of tangency on which said support contacts said respective support rolls is adjusted so as to satisfy the expression:

$$b < 1.3 \times 10^3 \times \left( \frac{\pi^2 E t T}{12(1-\nu^2)} \right)^{\frac{1}{2}}$$

where t (mm) is a thickness of said support, E (kgf/mm$^2$) is the Young's modulus of said support, ν is the Poisson's ratio of said support, and T (kgf/mm) is a carrying tension per unit width of said support.

2. The coating method of claim 1, wherein the support has a thickness of 4 μm to 10 μm.

3. The coating method of claim 1, wherein the distance b is adjusted so as to satisfy the expression:

$$t \times \left( \frac{\delta E}{7.6 \times 10^{-10} (1-\nu^2)} \right)^{\frac{1}{3}} < b$$

where δ (mm) is a deviation due to the rotation of each of said support rolls.

4. The coating method of claim 3, wherein the support has a thickness of 4 μm to 10 μm.

5. A coating method including continuously running a surface of a flexible support, supported by a pair of rotational support rolls, along a back edge surface and a doctor edge surface; and coating the surface of said support with a coating composition in a region between said pair of support rolls by an extrusion coating apparatus which extrudes said coating composition continuously from a top end portion of a slot onto the surface of said support, said pair of support rolls including an upstream roll and a downstream roll, said upstream roll defining a point of tangency which is where said support last contacts said upstream roll before extending toward said slot, and said downstream roll defining a point of tangency which is where said support first contacts said downstream roll, the improvement comprising:

performing said coating under a condition wherein a distance b (mm) from the top end portion of said slot to each of the points of tangency on which said support contacts said respective support rolls is adjusted so as to satisfy the expression:

$$b > t \times \left( \frac{\delta E}{7.6 \times 10^{-10} (1-\nu^2)} \right)^{\frac{1}{3}}$$

where t (mm) is a thickness of said support, E (kgf/mm$^2$) is the Young's modulus of said support, ν is the Poisson's ratio of said support, and δ (mm) is a deviation due to the rotation of each of said support rolls.

6. The coating method of claim 5, wherein the support has a thickness of 4 μm to 10 μm.

* * * * *